US012000225B2

(12) United States Patent
Cronley

(10) Patent No.: US 12,000,225 B2
(45) Date of Patent: Jun. 4, 2024

(54) COILED TUBING SECTION MILL

(71) Applicant: DYNASTY ENERGY SERVICES, LLC, Lafayette, LA (US)

(72) Inventor: Gerald J. Cronley, Gretna, LA (US)

( * ) Notice: Subject to any disclaimer, the term of this patent is extended or adjusted under 35 U.S.C. 154(b) by 0 days.

(21) Appl. No.: 18/477,827

(22) Filed: Sep. 29, 2023

(65) Prior Publication Data

US 2024/0110453 A1 Apr. 4, 2024

Related U.S. Application Data

(60) Provisional application No. 63/378,308, filed on Oct. 4, 2022.

(51) Int. Cl.
*E21B 29/00* (2006.01)
*E21B 17/20* (2006.01)

(52) U.S. Cl.
CPC ..... *E21B 29/005* (2013.01); *E21B 17/20* (2013.01)

(58) Field of Classification Search
CPC ..... E21B 29/005
See application file for complete search history.

(56) References Cited

U.S. PATENT DOCUMENTS 1,789,995 A 1/1931 Barkis
2,899,000 A 8/1959 Medders et al.
3,117,626 A * 1/1964 Ringler ..... E21B 29/005 166/55.7
3,254,720 A * 6/1966 Huitt ..... E21B 29/00 175/269
5,373,900 A 12/1994 Lynde et al.
5,385,205 A 1/1995 Hailey
5,765,640 A * 6/1998 Milne ..... E21B 47/09 166/212
7,063,155 B2 6/2006 Ruttley
9,695,660 B2 7/2017 Ruttley
9,938,781 B2 4/2018 Bansal et al.
10,012,048 B2 7/2018 Segura et al.
10,161,209 B1 12/2018 Hutchinson
10,202,814 B2 2/2019 Fuller et al.
10,240,418 B2 3/2019 Ruttley
10,344,548 B2 7/2019 Ruttley et al.
10,526,849 B2 1/2020 Lin et al.
10,605,025 B2 3/2020 Ruttley
10,815,745 B2 10/2020 Dewey et al.
10,989,005 B2 4/2021 Ruttley
11,248,430 B2 2/2022 Ruttley et al.
(Continued)

*Primary Examiner* — David Carroll

(57) ABSTRACT

A section mill having a tubular mill body is attached to a carrier pipe string such as a coiled tubing string. A translatable elongated tubular piston mandrel is positioned within the mill body to receive a flow of fluid from a central fluid bore in the carrier pipe string. The tubular piston mandrel has attached upper and lower pistons respectively positioned within upper and lower piston chambers in the mill body. The pistons move the piston mandrel vertically upward and downward in response to fluid pressure generated by fluid from the tubular piston mandrel. Longitudinally adjustable plungers are attached to the tubular piston mandrel. Cutter shoes are mounted to the adjustable plunger by pivotally attached yoke links. The yoke links and cutter shoes pivot radially inward and outward by upward and downward movement of the tubular piston mandrel and the attached adjustable plungers.

20 Claims, 8 Drawing Sheets

(56) References Cited

U.S. PATENT DOCUMENTS

| | | | | |
|---|---|---|---|---|
| 11,274,514 | B2 | 3/2022 | Segura et al. | |
| 11,441,378 | B2 | 9/2022 | Ruttley | |
| 2011/0220357 | A1* | 9/2011 | Segura | E21B 29/005 166/55.3 |
| 2013/0213641 | A1 | 8/2013 | Layden et al. | |
| 2015/0354320 | A1 | 12/2015 | Mahajan et al. | |
| 2016/0130899 | A1 | 5/2016 | Cronley | |
| 2018/0100373 | A1* | 4/2018 | Krüger | E21B 47/005 |
| 2019/0106958 | A1* | 4/2019 | Ruttley | E21B 29/005 |
| 2022/0025727 | A1 | 1/2022 | Ruttley et al. | |

* cited by examiner

COILED TUBING SECTION MILL

CROSS-REFERENCE TO RELATED APPLICATIONS

This application claims priority to U.S. Provisional Application Ser. No. 63/378,308 entitled "Coiled Tubing Section Mill" filed Oct. 4, 2022, the entire content of which is incorporated by reference.

FIELD OF INVENTION

This invention relates to the field of sub-surface wellbore tools and equipment and, more particularly, to a coiled tubing operable section mill for milling wellbore tubulars or casing.

BACKGROUND OF INVENTION

Oil and gas wellbores are typically lined with a string or strings of wellbore tubulars such as a string of casing pipe. Section mills are used to mill or cut through a section of a wellbore tubular during various phases of the drilling and production process or during remediation of the wellbore post the production life of the well. Such section mills are included in a tool carrier pipe string, placed within the wellbore tubular, and positioned at a desired location where the milling is to take place.

A section mill may employ at least one retractable rotatable cutter. The retractable cutter retracts inwardly when the section mill is moved through the wellbore tubular and extends radially outward from the section mill to engage the inside diameter of the wellbore tubular where milling is to proceed. Circulating wellbore fluid is used to extend and retract the associated cutters. Milling is accomplished by rotation of the section mill and the extended cutters against the engaged wellbore tubular enable milling of the wellbore tubular.

The cuttings or swarf from the milling process are then circulated out of the wellbore through the annulus between the carrier pipe string and the wellbore tubular by means of the circulating wellbore fluid.

Problems associated with the use of section mills, whether drill string deployed section mills or coiled tubing deployed section mills, include wobbling and vibration of the rotatable cutters during rotation, incomplete or unreliable extension and retraction of the rotatable cutters, inadequate radial force on the rotatable cutters that results in incomplete or inadequate cuts in the tubular being milled, the inability to mill both upwards and downward, excessive wear on the cutters and the cutter drive system, limitations on the length of the cutting area or window, and limitations on their use within small diameter wellbore tubulars due to sizing considerations.

The aforementioned problems, among others, result in reduced milling efficiency, increased wear and tear on the section mill, increased milling time, and increased cost of the milling operations. Consequently, there is a need for a section mill that will reduce or eliminate such problems and thus reduce the time and cost associated with the milling process, and ultimately the cost of oil and gas production and associated well remediation.

SUMMARY OF THE INVENTION

The section mill of the present invention is intended to reduce or eliminate the aforementioned problems and it is particularly suitable for use on a coiled tubing carrier pipe string for milling or cutting a liner pipe string positioned along the length of a wellbore. The section mill is comprised of a longitudinally extending tubular mill body having a central fluid bore that is threadedly attached at its upper end to the lower end of a tubular top sub that is threadedly attached at its upper end to a carrier pipe string having a central fluid bore. The top sub is threadedly attached to the carrier pipe string so that a central fluid bore in the top sub is in fluid communication with the central fluid bore of the tubular mill body and with the central fluid bore within the carrier pipe string.

Preferably, the carrier pipe string will be a coiled tubing string having a fluid driven downhole motor and the top sub with be threadedly attached to the carrier pipe string downhole from the fluid driven downhole motor. When the carrier pipe string is a coiled tubing string, the circulation of fluid, such as drilling fluid, through the central fluid bore of the coiled tubing string and through the downhole motor will rotate the attached top sub and the attached section mill. However, the section mill of the present invention may also be utilized by attachment to a top sub that is a component of a carrier pipe string that is rotated by a rotary table or by a top drive.

The central fluid bore of the longitudinally extending tubular mill body of the section mill has aligned upper and lower piston chambers. A translatable elongated, i.e., longitudinally extending, tubular piston mandrel is positioned within the central bore of the tubular mill body. The translatable elongated tubular piston mandrel has a central piston mandrel fluid bore and attached upper and lower pistons that are respectively positioned within the upper and lower piston chambers in the tubular mill body. The upper and lower piston chambers receive an inward and outward flow of wellbore fluid from the central bore of the carrier pipe string through corresponding fluid ports in said piston mandrel fluid bore. This wellbore fluid creates fluid pressure to move the upper and lower pistons and the attached piston mandrel vertically upward (uphole) and vertically downward (downhole) in response to fluid pressure generated by the flow of fluid into and out of the upper and lower piston chambers. Longitudinally adjustable plungers are attached to the lower or downhole end of the tubular piston mandrel for attachment to elongated cutter shoes.

The elongated cutter shoes, i.e., longitudinally extending, are pivotally attached to the tubular mill body by pairs of vertically arrayed pivotable support links and to the adjustable plungers by pairs of pivotable yoke links. Preferably, the elongated cutter shoes will be offset or staggered along the length of the tubular mill body. The use of staggered cutter shoes allows the overall diameter of the section mill to be minimized.

Upward and downward movement of the tubular piston mandrel with the attached adjustable plungers is transmitted to the elongated cutter shoes by the pivotable yoke links and the support links. This upward and downward movement will pivot the support links radially to extend and retract the cutter shoes outward and inward from the tubular mill body through mill windows provided in the tubular mill body. Preferably, the cutter shoes retain an array of hardened cutters for milling and cutting the liner piper string although only a single hardened cutter may be utilized on the cutter shoes. Preferably, the array of hardened cutters extends longitudinally along the length of the cutter shoes.

Upward movement of the tubular piston mandrel with the attached adjustable plunger will pull the cutter shoes upward, in response to fluid pressure fluid pressure in the upper and lower piston chambers, to pivot the cutter shoes radially outward on the support links. The upward and outward pivoting of the support links extends the cutter shoes longitudinally from the tubular mill body through the mill windows to engage a longitudinal section of the liner pipe string with the hardened cutters of the cutter shoes. Milling of the liner pipe string is accomplished by rotation of the tubular mill body with the cutter shoes extended to engage the interior wall of the liner pipe string.

Downward movement of the tubular piston mandrel with the attached adjustable plunger, in response to fluid pressure in the upper and lower piston chambers, will push yoke links and the cutter shoes downward and pivot the cutter shoes radially inward on the support links. The downward and inward pivoting of the support links retracts the cutter shoes longitudinally through the mill windows into the tubular mill body. The cutter shoes may be dressed for either upward or downward milling by adjusting the number, type, and position of the hardened cutters on the cutter shoes.

When assembled as described herein and inserted into a liner pipe string of a wellbore, pressure exerted on the extended cutter shoes against the liner pipe string from upward movement of the tubular piston mandrel will reduce wobbling and vibration induced during rotation of the cutter shoes and provide more reliable milling. Further, the force exerted of the extended cutter shoes by the dual pistons will reduce the occurrence of incomplete or unreliable extension and retraction of the cutter shoes. The offset or staggered cutter shoes allow for a smaller diameter section mill to facilitate its use within small diameter wellbore tubulars. Adjustment bolts in the adjustable plungers allow for adjustment of the upward and downward travel of the plunger and thus the radial extension of the cutter shoes.

These and other advantages will be apparent from the description provided herein.

Figure 1A:
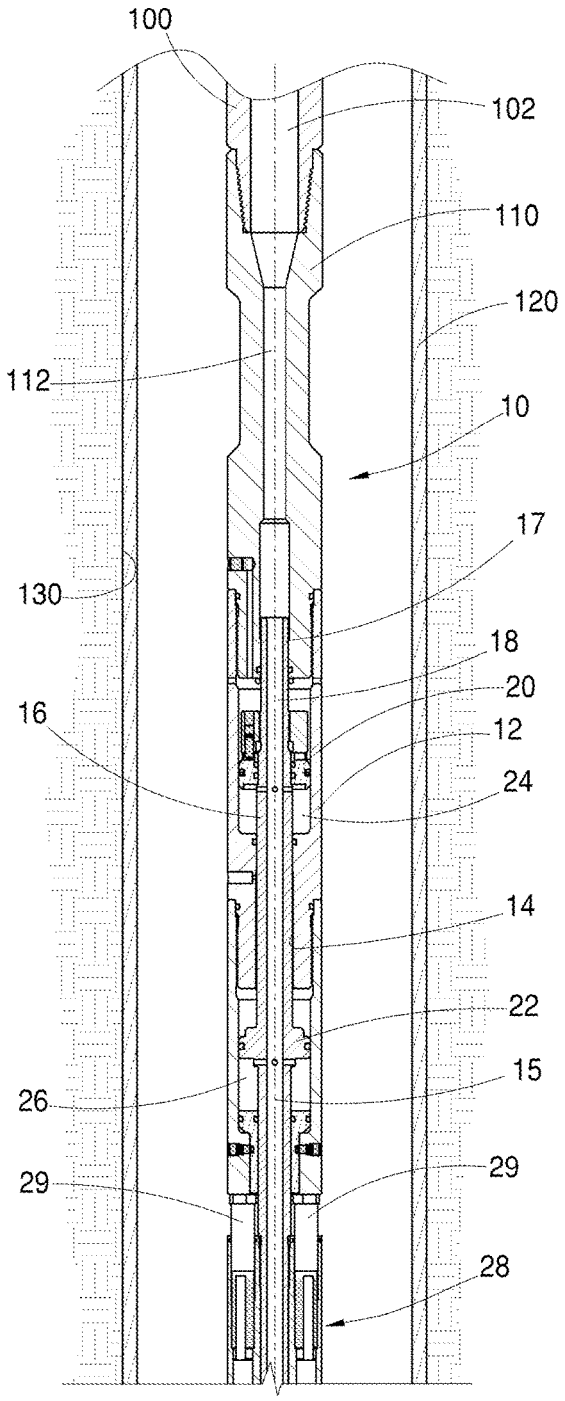
FIGS. 1A and 1B show a longitudinal cross-section view of an embodiment of the proposed section mill positioned in a wellbore.

These drawings may omit features that are established in the art and do not bear upon points of novelty in the interest of descriptive clarity. Such omitted features may include bearings, threaded junctures, weld lines, sealing elements, O-rings, pins, and brazed junctures.

DETAILED DESCRIPTION OF THE INVENTION

FIGS. 1 through 6B show the proposed section mill (10) with its principal components. For use, the section mill (10) is threadedly attached to the downhole end of a top sub (110) of a carrier pipe string (100) that is positioned within a liner pipe string (120) in a well bore (130) as shown in FIGS. 1A and 1B, The carrier pipe string (100) has a central bore (102) that is in fluid communication with a central bore (112) in the top sub (110). Preferably the carrier pipe string (100) is a coiled tubing string with the top sub (110) attached downhole from a fluid driven downhole motor, not shown, though another type of carrier pipe string may also be utilized. The circulation of fluid through the central bore (102) of the carrier pipe string (100) comprised of a coiled tubing and its downhole motor serves to rotate the attached top sub (112) and the section mill (10).

The section mill (10) has a longitudinally extending tubular mill body (12) and a central bore (14) that extends along the central longitudinal axis (15) of the tubular mill body (12). The central bore (14) of the tubular mill body (12) is in fluid communication with the central bore (112) of the top sub (110). A translatable elongated tubular piston mandrel (16) is positioned to extend within the central bore (14) of the tubular mill body (12). The tubular piston mandrel (16) has an uphole end (17), a downhole end (19), and a piston mandrel central bore (18) in fluid communication with the central bore (112) of the top sub (110). The piston mandrel central bore (18) at the uphole end (17) of the tubular piston mandrel (10) is configured to receive a flow of fluid transmitted through the central bore (102) of the carrier pipe string (100) and the central bore (112) of the top sub (110). The piston mandrel (16) supports dual attached pistons comprised of an upper piston (20) and a lower piston (22). The upper piston (20) is attached to the piston mandrel (16) and positioned within an upper piston chamber (24) within the central bore (14) of the tubular mill body (12) and the lower piston (22) is attached to the piston (16) and positioned within a lower piston chamber (26) within the central bore (14) of the tubular mill body (12).

Longitudinally adjustable plungers (28) are attached to the tubular piston mandrel (16) at its downhole end (19) by threaded adjustment bolts (29). The adjustment bolts (29) allow the adjustable plungers (28) to be threadedly adjusted both uphole and downhole with respect to the downhole end (19) of the piston mandrel (16). A first elongated longitudinally extending cutter shoe (30) is pivotally attached to a selected adjustable plunger (28) by a yoke link (31) and pivotally attached to the tubular mill body (12) by support links (33) that pivot about hinge pins (25). A second elongated cutter shoe (32) is offset or staggered from the first elongated cutter shoe (30) is pivotally attached to a selected adjustable plunger (28) by yoke links (31) and pivotally attached to the tubular mill body (12) cutter support links (33) that pivot about hinge pins (25). The yoke links (31) are preferably comprised of a pair of opposing yoke link segments and the cutter support links (33) are preferably comprised of opposing support link segments.

Figure 4A:
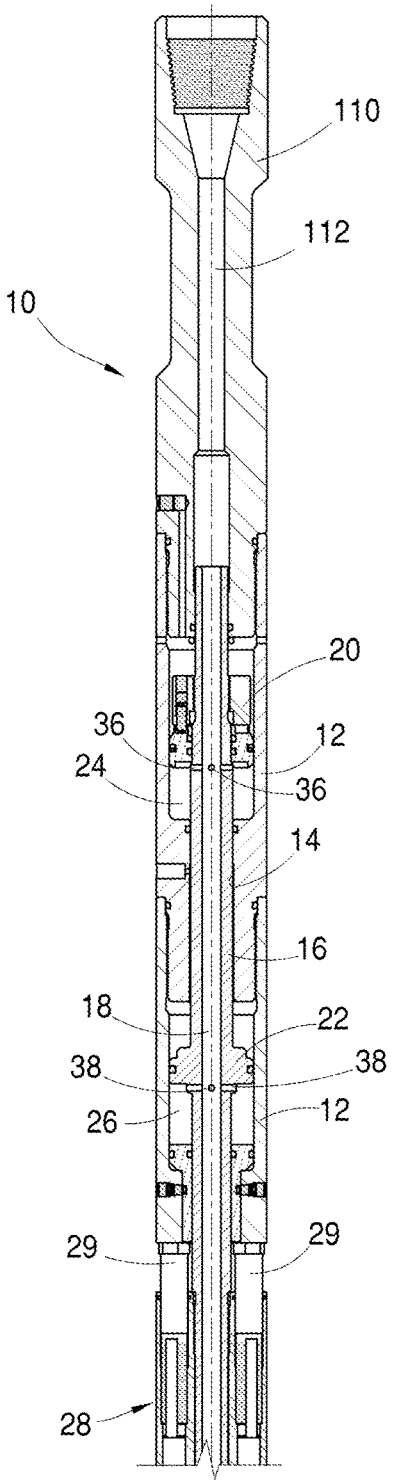
FIGS. 4A and 4B show an enlarged longitudinal cross-section view of the section mill of FIG. 1 with the cutter shoes extended.
Figure 5A:
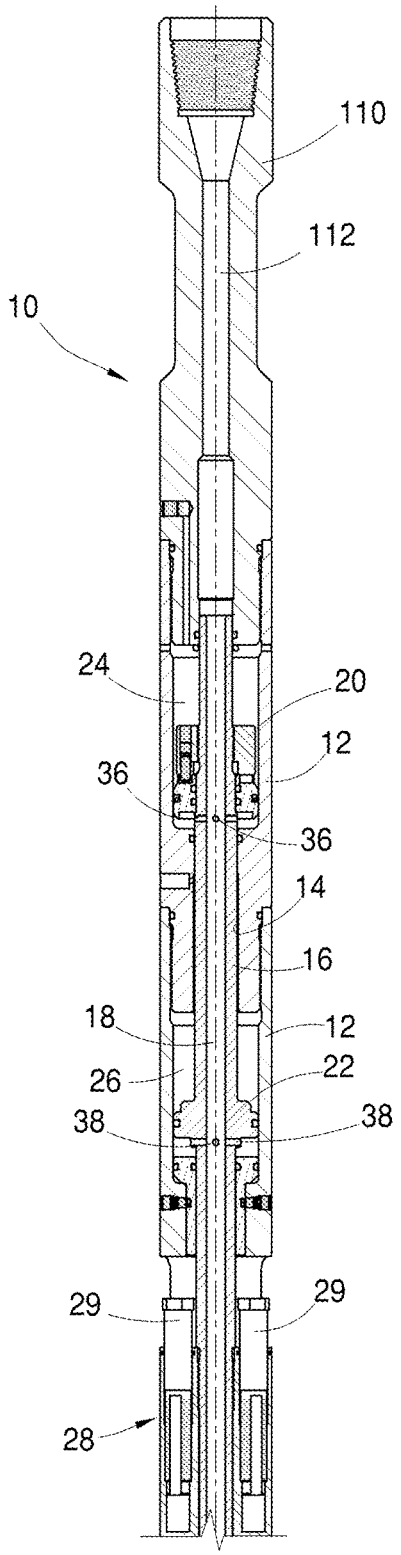
FIGS. 5A and 5B show a longitudinal cross-section view of the section mill of FIG. 1 with the cutter shoes retracted.

A detailed view of the upper portion of the section mill (10) and its upper and lower pistons is shown in FIGS. 4A and 5A. The upper piston (20) is attached to the piston mandrel (16) and fitted within the upper piston chamber (24). Upper fluid ports (36) in the piston mandrel (16) provide for a flow of fluid into and out of the upper piston chamber (24) from and to the central bore (18) of the tubular piston mandrel (16). The lower piston (22) is attached to the piston mandrel (16) and fitted within the lower piston chamber (26). Lower fluid ports (38) in the piston mandrel (16) provide for a flow of fluid into and out of the lower piston chamber (26) from and to the central bore (18) of the tubular piston mandrel (16). The flow of fluid into and out of the piston chambers (24, 26) through fluid ports (36,38) moves the upper piston (20), lower piston (22) and the attached tubular piston mandrel (16) upward and downward.

Figure 4B:
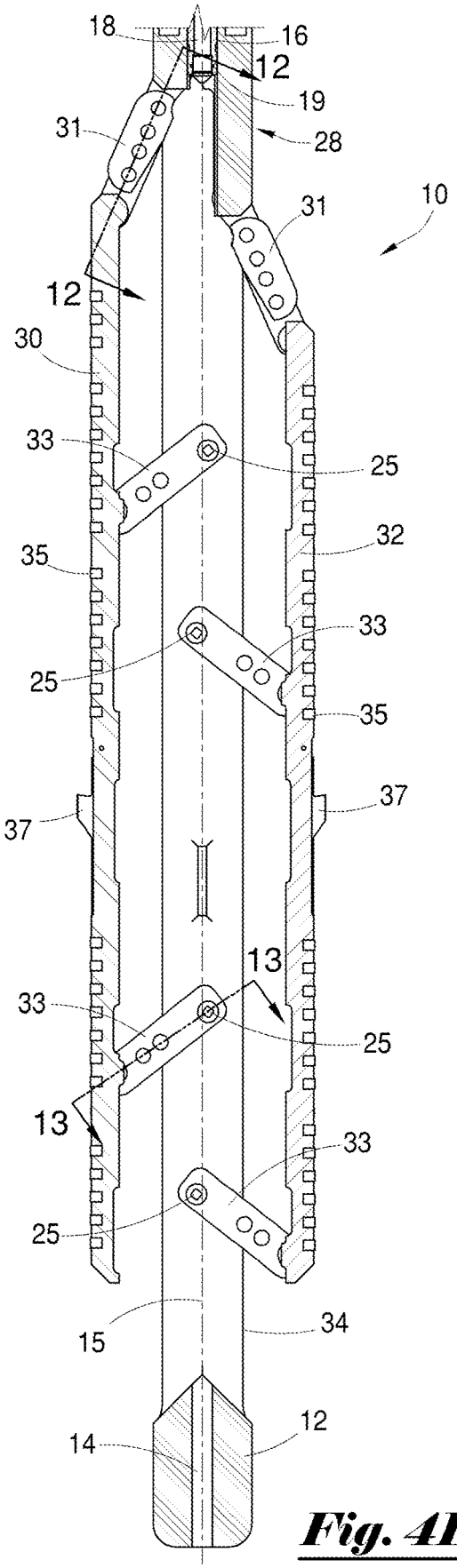
Figure 5B:
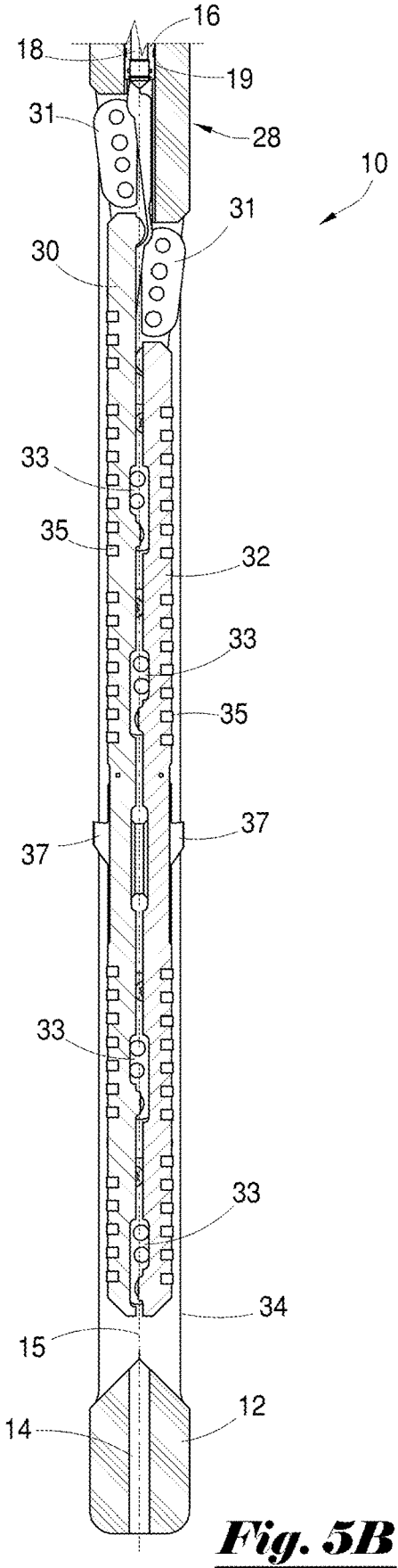

A detailed view of the downhole portion of the section mill (10) and the configuration of its cutting shoes is shown in FIGS. 4B and 5B. Upward and downward movement of the tubular piston mandrel (16) with the attached adjustable plungers (28) will pivot the yoke links (31) and the support links (33) longitudinally radially outward and inward to extend and retract the elongated cutter shoes (30) and (32) through mill windows (34) in the tubular mill body (12). The first and second cutter shoes (30) and (32) may be configured to retain cutter inserts (35) or cutting blades (37) having hardened cutting surfaces such as a carbide surface, a polycrystalline diamond surface, or the like to facilitate milling and cutting. The cutter shoes (30) and (32) may be dressed for upward and downward milling by adjusting the number, type. A variety of alternate or replacement cutter blades may be provided to allow the milling tool (10) to be altered in field as desired simply by disassembly of the yoke links (31) and the support links (33) as shown in FIG. 7 and FIG. 8 and attachment of a replacement cutter blade.

Figure 7:
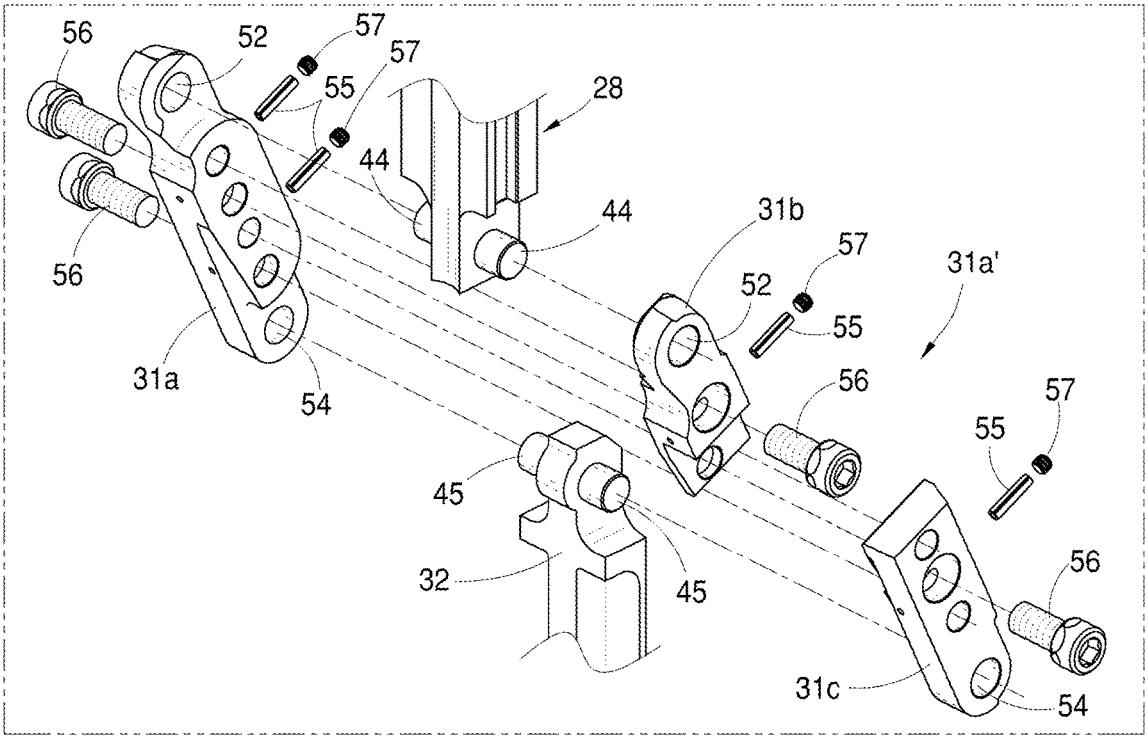
FIG. 7 is an exploded view of the connection of the yoke links to the adjustable plunger and to the carrier shoes.

FIG. 7 is an exploded view of the yoke (31) used to connect the adjustable plungers (28) to the cutter shoes (30) and (32). The yoke (31) may be comprised of a pair of matching opposing yoke link sections. The yoke (31) may be comprised of a pair of yoke link sections (31*a*) that have corresponding bores (52) that match with the studs (44) on the adjustable plunger (28) and corresponding bores (54) that match with the studs (45) on the cutter shoes (30) and (32). One or more bolts (56) locks the yoke link sections (31*a*) together over the studs (44) and (45) to complete the assembly of the yoke (31) to a selected adjustable plunger (28) and a selected cutter shoe (30) or (32). A pin (55) secured by a pipe plug (57) keeps the bolt (56) in place.

Figure 12:
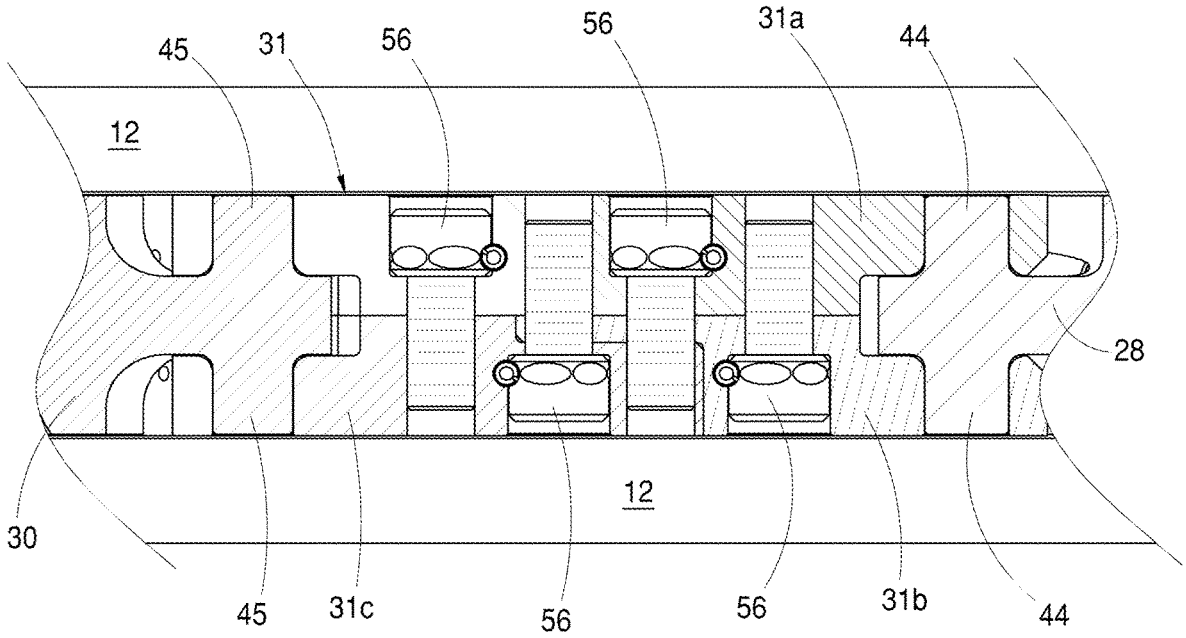
FIG. 12 is a cross-section view cut along section 12-12 of FIG. 4B showing the pivot connection of a yoke link to a cutter shoe and to the adjustable plunger.

Alternatively, one of the yoke link sections (31*a*) may be configured as a yoke link section shown as yoke link section (31*a*') that is comprised of a yoke link section (31*b*) and a yoke link section (31*c*) that are joined together to match with an opposing yoke link section (31*a*). Such a configuration will facilitate disassembly and reassembly of the cutter carriers (30) and (32) from the adjustable plunger (28). The opposing yoke link sections (31*a*) create the two-piece yoke (31) that may be readily disassembled in the field to replace worn or damaged cutter shoes or to utilize a different type of cutter shoe without having to remove the adjustable plunger (28) from the tubular mill body (12). FIG. 12 is a cross-section view of a yoke link (31 cut along section 12-12 of FIG. 4B showing the pivotal connection of yoke link (31) to cutter shoe (30) and to the adjustable plunger (28).

Figure 8:
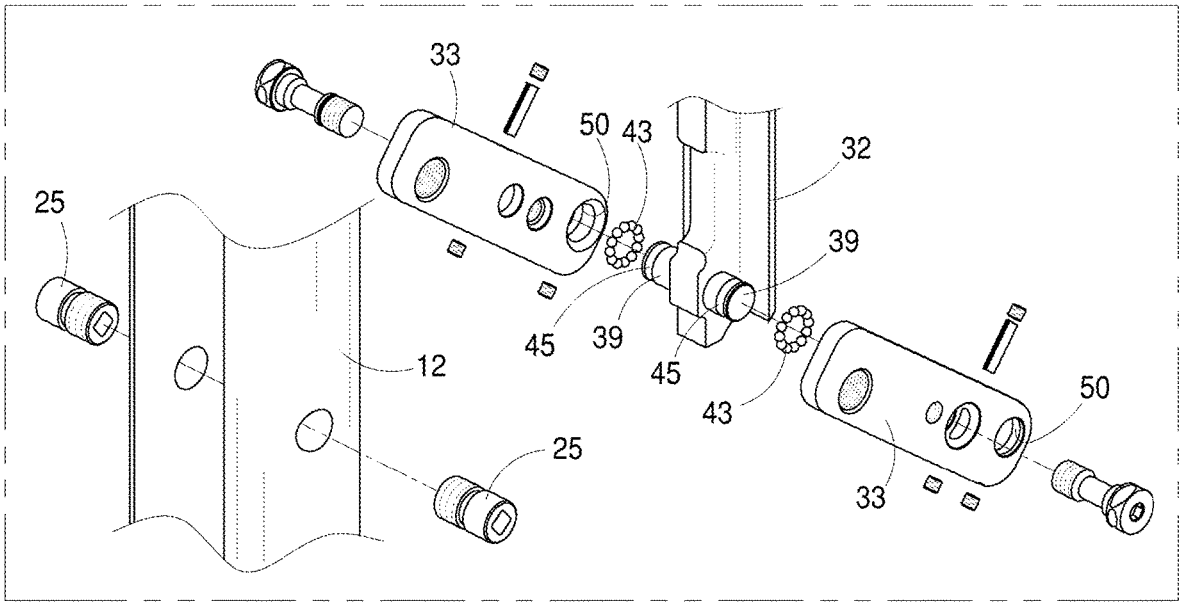
FIG. 8 is an exploded view of the connection of the carrier support links to the tubular mill body and to the cutter shoes of the section mill of FIG. 1.
Figure 13:
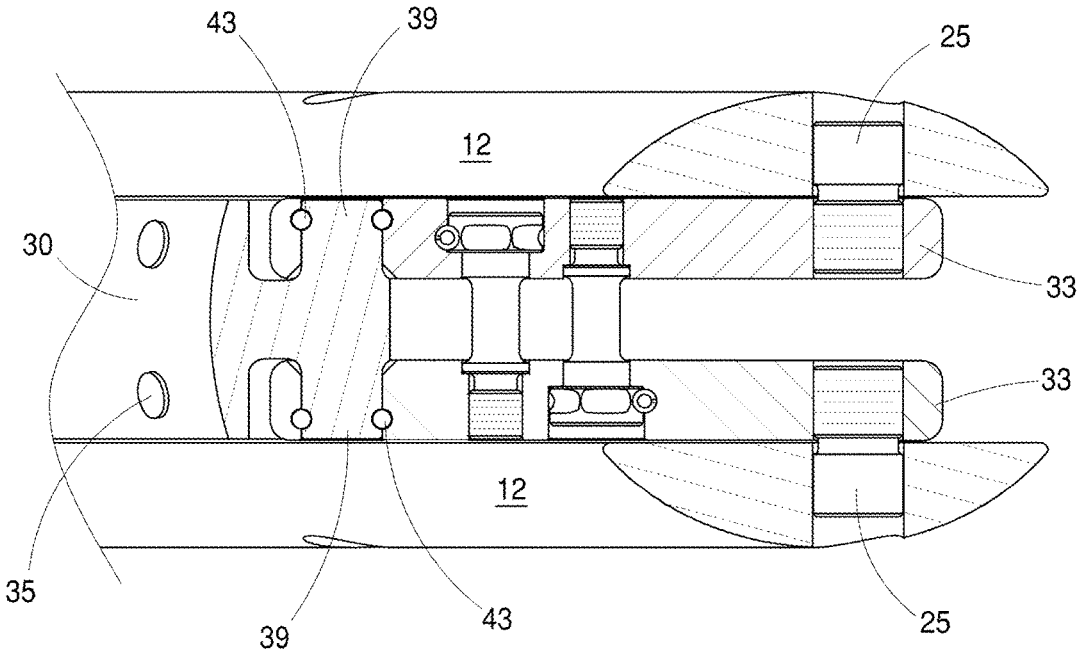
FIG. 13 is a cross-section view cut along section 13-13 of FIG. 4B showing the pivot connection of a cutter shoe support link to a cutter shoe and to the tubular mill body.

FIG. 8 is an exploded view of the cutter carrier support links (33) used to pivotally connect the cutter shoes (30) and (32) to the tubular mill body (12) of the section mill (10) at the mill window (34). Pairs of cutter support links (33) are used to pivotally attached the cutter shoes (30) and (32) at cutter shoe posts (39) that protrude from the cutter shoes (30) and (32). Ball bearings (43) may be placed in a bearing race (54) formed by adjoining grooves (56) machined into the cutter shoe post (39) and the support links (33). The ball bearings (43) may be placed in the bearing race (50) via passage holes (not shown) positioned in the links (33). The support links (33) are pivotally connected to the tubular mill body (12) by means of hinge pins (25). Preferably, hinge pins (25) will be tapered pins that screw into the support links (33). Ball bearings (43) may also be utilized in the connection of the support links (33) to the hinge pins (25). FIG. 13 is a cross-section view of a cutter shoe support link (33) cut along section 13-13 of FIG. 4B showing the pivotal connection of a cutter shoe support link (33) to a cutter shoe (30) and to the tubular mill body (12).

Figure 9:
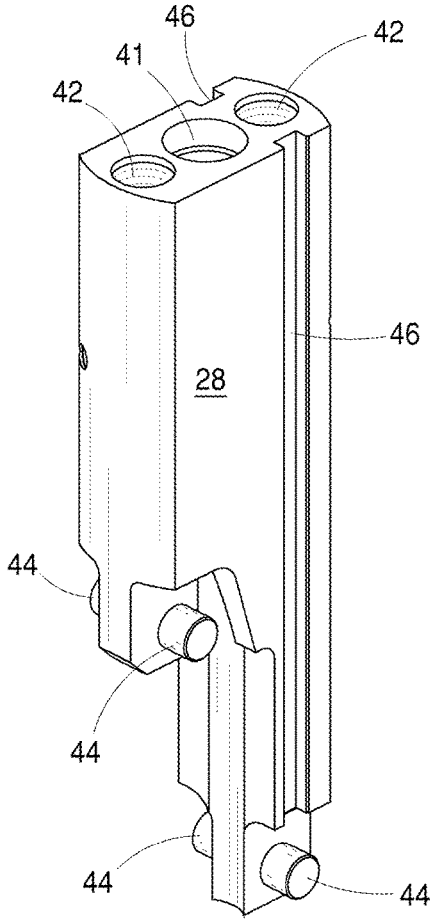
FIG. 9 is a perspective view of the adjustable plunger of the section mill of FIG. 1.

The adjustable plunger (28) is shown in an isometric view in FIG. 9. The adjustable plunger (28) has a central bore (41) through which the tubular piston mandrel (16) is inserted. Threaded adjustment bores (42) are configured to receive threaded adjustment bolts (29) for threaded adjustable attachment to the tubular piston mandrel (16). The adjustable plunger (28) is provided with attachment studs (44) for pivotal attachment of the yokes (31) which pivotally attach to cutter shoes (30) and (32). Slots (46) are provided on the adjustable plunger (28) to align with keys (48) milled into the tubular mill body (12) to facilitate upward and downward movement of the adjustable plunger (28).

Figure 6A:
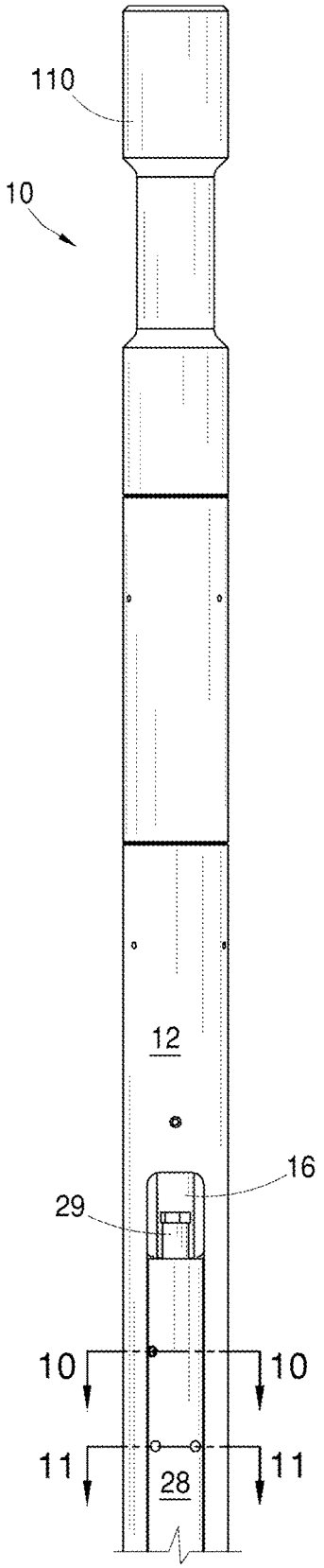
FIGS. 6A and 6B show a side view of the section mill of FIG. 1.
Figure 6B:
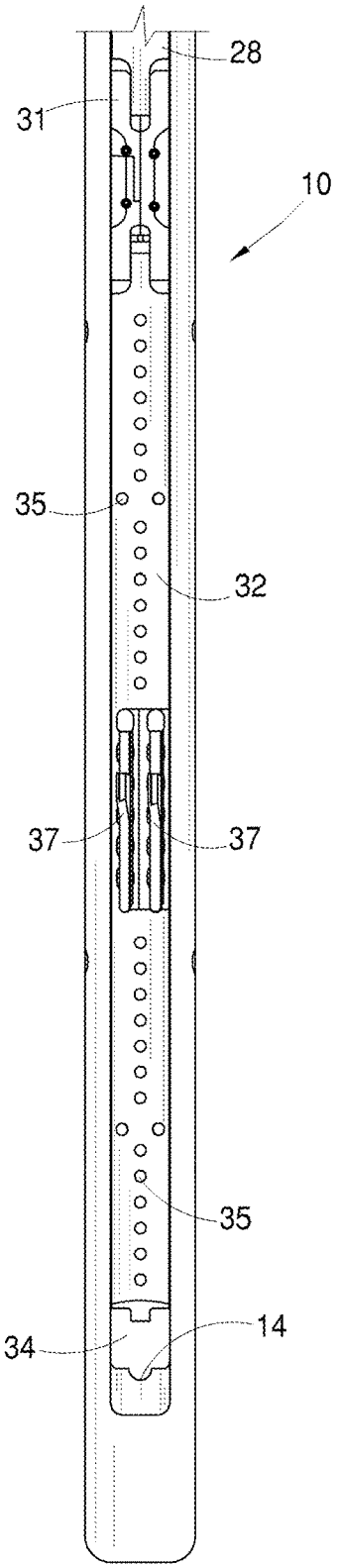
Figure 10:
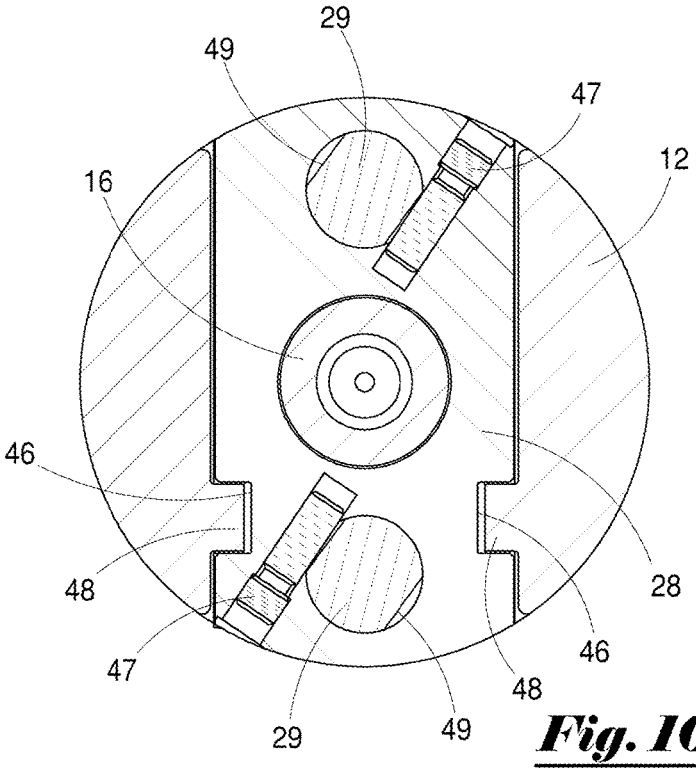
FIG. 10 is a horizontal cross-section view cut along section 10-10 of FIG. 6A showing the adjustable plunger connected to the tubular piston mandrel.
Figure 11:
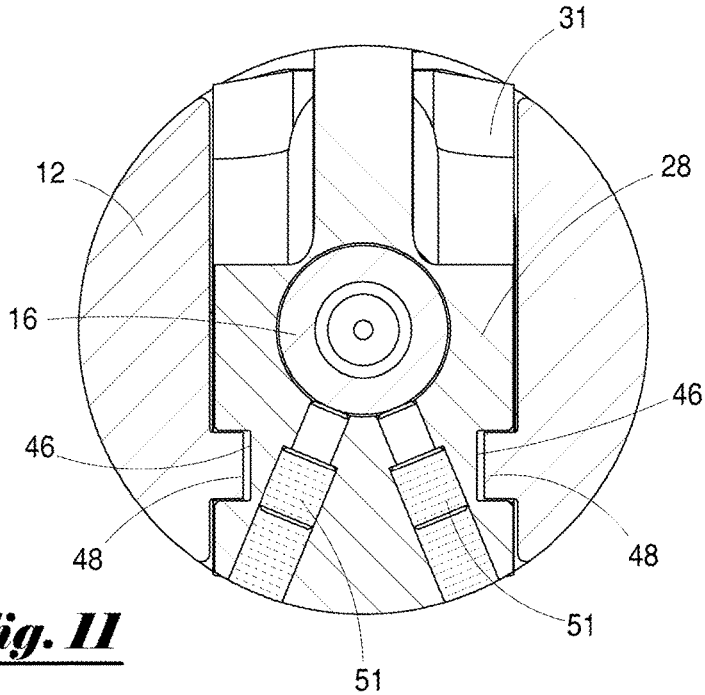
FIG. 11 is a horizontal cross-section view cut along section 11-11 of FIG. 6A showing the translatable piston mandrel.

FIG. 10 shows a horizontal cross-section view cut along section 10-10 of FIG. 6A showing the adjustable plunger connected to the tubular piston mandrel (16). Set screws (47) engage with flats (49) on the adjustment bolts (29) to secure the adjustment bolts (29) to the adjustable plungers (28) at a desired position. As shown in FIG. 11, a horizontal cross-section view cut along section 11-11 of FIG. 6A, set screws (51) lock the tubular piston mandrel (16) to the adjustable plungers (28). FIG. 12 shows a cross-section view of a yoke line cut along section 12-12 of FIG. 4B showing the pivot connection of yoke link to a cutter shoe and to the adjustable plunger.

FIG. 13 is a cross-section view of a cutter shoe cut along section 13-13 of FIG. 4B showing the pivot connection of a cutter support link to a cutter shoe and to the tubular mill body.

Figure 1B:
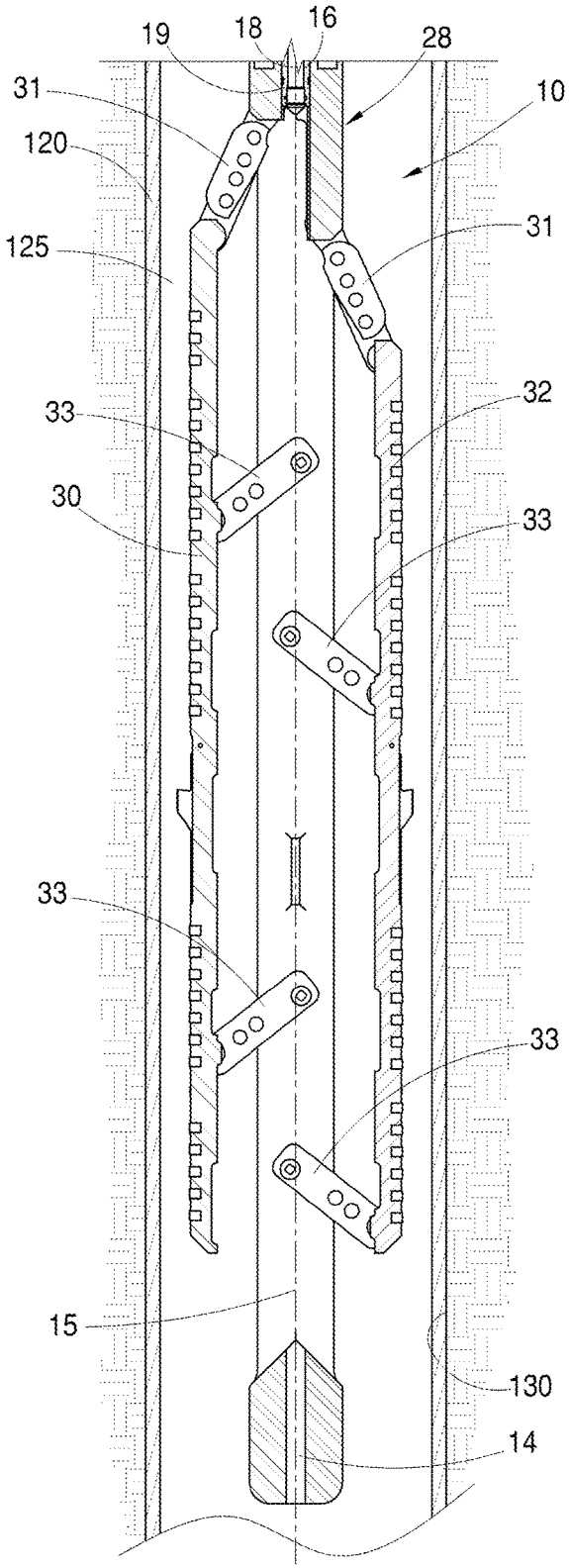
Figure 2:
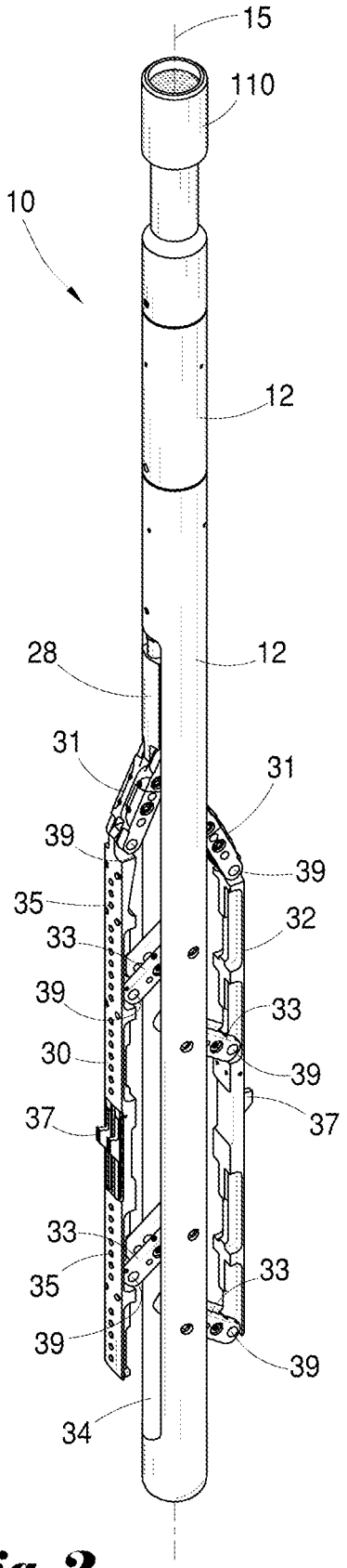
FIG. 2 is a longitudinal perspective view of the section mill of FIG. 1 with the cutter shoes extended.
Figure 3:
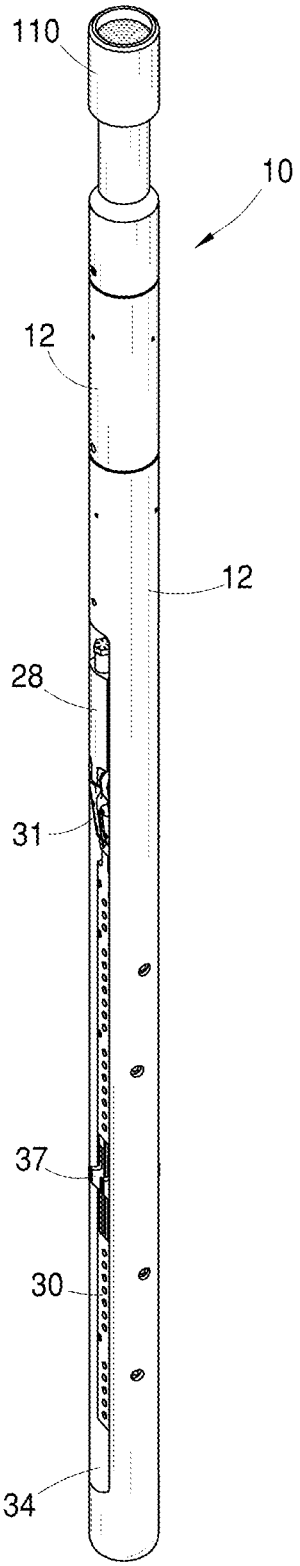
FIG. 3 is a longitudinal perspective view of the section mill of FIG. 1 with the cutter shoes retracted.

For operation of the section mill (10), the uphole end of the top sub (112) is threadedly connected to the carrier pipe string (100) and the section mill (10) is threadedly connected to the top sub (112) at its downhole end. The tool carrier pipe string (100), top sub (112), and the connected section mill (10) are then inserted through the liner pipe string (120) of the well bore (130) and lowered to a desired downhole location in the liner pipe string (120) as shown in FIGS. 1A and 1B.

When the section mill (10) is lowered to the desired location in the liner pipe string (120), fluid is then pumped into the central bore (102) of the tool carrier pipe string (100) and through the central bore (112) of the top sub (112) to enter the central bore (14) of the tubular mill body (12) of the section mill (10). The fluid from the central bore central bore (14) of the tubular mill body (12) exits into the central bore (18) of the tubular piston mandrel (16) to enter into the upper fluid chamber (24) through upper fluid ports (36) and into the lower fluid chamber (26) through the lower fluid ports (38). The fluid in the upper fluid chamber (24) and the lower fluid chamber (26) generates fluid pressure on the upper piston (20) and lower piston (22) and translates the tubular piston mandrel (16) and the attached adjustable plunger (28) upward in an uphole direction. The upward movement of the adjustable plunger (28) pivots the attached yoke link sections (31) upwardly about the plunger stud (44) and the support links (33) upwardly about the hinge pins (25) to extend the cutter shoes (31) and (33) radially outward from the tubular mill body (12) through mill window (34) to engage the liner pipe string (120) or another tubular to be milled.

When extended through the mill window (24), the cutter shoes (30) and (32) and the associated cutter inserts (35) or blades (37) will be positioned against the liner pipe string (120). Milling is then conducted by rotating the milling tool (10) either by the downhole motor on the carrier pipe string (100) or by a rotary or top drive to engage the cutter inserts (35) or blades (37) on the cutter shoes (30) and (32) the liner pipe string (120) for milling. Cuttings created during milling are carried away by fluid circulation through the central bore (14) of the tubular mill body (12), upward in the annulus (125) between the tubular mill body (12) and the liner pipe string (120).

Once fluid pumping ceases, fluid pressure in the central bore (14) is relieved and fluid in the upper piston chamber (24) and lower piston chamber (26) exits to the central bore (18) of the piston mandrel (16) through fluid ports (36) and (38). The exiting fluid causes the piston mandrel to move downward to pivot the yoke link sections (31) downwardly about the plunger stud (44) and to pivot the support links (33) downwardly about the hinge pins (25) to move the cutter shoes (30) and (32) radially inward away from the liner pipe string (120) into the tubular mill body (12) of the milling tool (10) to allow the section mill (10) to be removed from the casing tubular (120).

It is thought that the embodiments of the section mill 10 presented herein and its attendant advantages will be understood from the foregoing description. It will be apparent that various changes may be made in the form, construction, and arrangement of the parts of the embodiments of the section mill 10 without departing from the spirit and scope of the invention or sacrificing its material advantages. The form and construction described and illustrated herein are merely example embodiments of the invention.

The invention claimed is:

1. A section mill comprising:

(a) a carrier pipe string having a carrier pipe string central fluid bore;

(b) a longitudinally extending tubular mill body having a mill body central fluid bore in fluid communication with said carrier pipe string central fluid bore, (c) a translatable longitudinally extending tubular piston mandrel positioned within said mill body central fluid bore, said tubular piston mandrel having an upper end, a lower end, and a piston mandrel central fluid bore in fluid communication with said mill body central fluid bore;

(d) an upper piston chamber and a lower piston chamber in said tubular mill body, said upper piston chamber and said lower piston chamber in fluid communication with said piston mandrel central fluid bore;

(e) an upper piston attached to said elongated tubular piston mandrel, said upper piston positioned within said upper piston chamber;

(f) a lower piston attached to said elongated tubular piston mandrel, said lower piston positioned within said lower piston chamber;

(g) at least one plunger attached to said lower end of said tubular piston mandrel; and (h) a longitudinally extending cutter shoe pivotally attached to said plunger and to said tubular mill body.

2. The section mill recited in claim 1 wherein, said cutter shoe is configured to pivot radially outward from said mill body in response to upward movement of said tubular piston mandrel and radially inward into said mill body in response to downward movement of said tubular piston mandrel.

3. The section mill recited in claim 2 further comprising upper fluid ports in fluid communication with said tubular piston mandrel central fluid bore and said upper piston chamber and lower fluid ports in fluid communication with said tubular piston mandrel central fluid bore and lower piston chamber.

4. The section mill recited in claim 3, wherein said tubular piston mandrel is configured to move upward and downward in response to fluid pressure generated by fluid flow through said upper and said lower fluid ports.

5. The section mill recited in claim 4, wherein said cutter shoe has an upper end, said upper end of said cutter shoe pivotally attached to a yoke link that is pivotally attached to said plunger.

6. The section mill recited in claim 5, further comprising a cutter shoe support link, said cutter shoe support link pivotally attached to said cutter shoe and pivotally attached to said tubular mill body.

7. The section mill recited in claim 6, wherein said cutters shoe includes cutter surfaces.

8. The section mill recited in claim 7, wherein said cutter shoe support link is pivotally attached to said mill body by hinge pins.

9. The section mill recited in claim 8, further comprising an adjustment bolt attached to said tubular piston mandrel and said plunger whereby said plunger may be selectively positioned longitudinally with respect to said tubular piston mandrel.

10. The section mill recited in claim 9, wherein said yoke link is comprised of a pair of opposing yoke link segments and said cutter shoe support link is comprised of opposing support link segments.

11. The section mill recited in claim 10, further comprising a first and a second carrier shoe, said first and said second carrier shoes staggered along the length of said tubular mill body.

12. The section mill recited in claim 11, further comprising a tubular top sub attached between said tubular mill body and said carrier pipe string, said tubular top sub having a top sub central fluid bore in fluid communication with said carrier pipe string central fluid bore and said mill body central fluid bore.

13. The section mill recited in claim 12, wherein said section mill is configured to rotate for milling by rotation of said top sub.

14. The section mill recited in claim 13, further comprising a plurality of cutter shoe support links and a plurality of support posts on said first and said second carrier shoes, each said support post and each said cutter shoe support link having a bearing race having a bearing ball.

15. The section mill recited in claim 14, wherein said carrier pipe string is a coiled tubing string.

16. A section mill for milling a wellbore tubular comprising:

(a) a carrier pipe string, said carrier pipe string having a carrier pipe string central fluid bore;

(b) a top sub, said top sub having an upper end, a lower end, and a top sub central fluid bore, said upper end of said top sub attached to said carrier pipe string whereby said top sub central fluid bore is in fluid communication with said carrier pipe string central fluid bore;

(c) a longitudinally extending tubular mill body, said tubular mill body having an upper end, a lower end, and a mill body central fluid bore, said upper end of said tubular mill body attached to said lower end of said top sub, whereby said top sub central fluid bore is in fluid communication with said mill body central fluid bore;

(d) a translatable longitudinally extending tubular piston mandrel positioned within said mill body central fluid bore, said tubular piston mandrel having an upper end, a lower end, and a piston mandrel central fluid bore in fluid communication with said mill body central fluid bore;

(e) an upper piston attached to said elongated tubular piston mandrel, said upper piston positioned within an upper piston chamber in said tubular mill body, said upper piston chamber in fluid communication within said piston mandrel central fluid bore;

(f) a lower piston attached to said elongated tubular piston mandrel, said lower piston positioned within a lower piston chamber in said tubular mill body, said lower piston chamber in fluid communication within said piston mandrel central fluid bore;

(g) a first plunger attached to said lower end of said tubular piston mandrel;

(h) a first longitudinally extending cutter shoe having at least one cutter surface, said first cutter shoe having an upper end and a lower end, (i) a first yoke link pivotally attaching said upper end of said first cutter shoe to said first plunger;

(j) a first support link pivotally attaching said first cutter shoe to said tubular mill body;

(k) a second plunger attached to said lower end of said tubular piston mandrel;

(l) a second longitudinally extending cutter shoe having at least one cutter surface, said second cutter shoe having an upper end and a lower end, (m) a second yoke link pivotally attaching said upper end of said second cutter shoe to said second plunger;

(n) a second support link pivotally attaching said second cutter shoe to said tubular mill body; and (o) wherein said first and said second yoke links are comprised of pairs of yoke link segments and wherein said first and said second cutter shoe support links are comprised of pairs of support link segments.

17. The section mill recited in claim 15, wherein:

(a) said tubular piston mandrel is configured to provide said fluid pressure in said upper and said lower piston chambers;

(b) said tubular piston mandrel is configured to move upward and downward in response to fluid pressure in said upper and said lower piston chambers; and (c) said first and said second cutter shoes are configured to pivot radially outward in response to upward movement of said tubular piston and radially inward in response to downward movement of said tubular piston mandrel.

18. The section mill recited in claim 16, further comprising:

(a) adjustment bolts attaching said first and said second plungers to said tubular piston mandrel whereby said first and said second plungers may be selectively positioned longitudinally along said tubular piston mandrel; and (b) wherein said first and said second carrier shoes are staggered longitudinally along said tubular mill body.

19. The section mill recited in claim 18, wherein said section mill is configured to rotate for milling by rotation of said top sub.

20. The section mill recited in claim 19, wherein said carrier pipe string is comprised of a coiled tubing string.

* * * * *